US008186530B2

(12) United States Patent
Bar

(10) Patent No.: US 8,186,530 B2
(45) Date of Patent: May 29, 2012

(54) FOOD TRAY

(75) Inventor: Avinoam Bar, Tel Aviv (IL)

(73) Assignee: Avinoam Bar, Tel Aviv (IL)

( * ) Notice: Subject to any disclaimer, the term of this patent is extended or adjusted under 35 U.S.C. 154(b) by 0 days.

(21) Appl. No.: 12/646,991

(22) Filed: Dec. 24, 2009

(65) Prior Publication Data

US 2012/0074034 A1 Mar. 29, 2012

(51) Int. Cl.
*B65D 25/20* (2006.01)
*B65D 1/34* (2006.01)
*A47B 23/00* (2006.01)

(52) U.S. Cl. ..... 220/17.1; 108/43; 206/562; 220/574; 220/738; 229/904

(58) Field of Classification Search ..... 206/549, 206/562, 563; 108/43; 220/17.1–17.3, 574, 220/737, 738; 229/117.23, 117.26, 402, 229/904; D6/406.3
See application file for complete search history.

(56) References Cited

U.S. PATENT DOCUMENTS

| | | | | | |
|---|---|---|---|---|---|
| 2,647,678 | A | * | 8/1953 | Olson | 229/402 |
| 2,979,990 | A | * | 4/1961 | Alexander | 108/43 |
| 3,142,425 | A | * | 7/1964 | Cobb | 229/400 |
| 4,033,489 | A | * | 7/1977 | Fowler | 206/216 |
| 4,705,173 | A | | 11/1987 | Forbes, Jr. | |
| 5,127,339 | A | * | 7/1992 | Hood, Jr. | 108/43 |
| D354,636 | S | * | 1/1995 | Cable | D6/406.4 |
| 5,425,455 | A | * | 6/1995 | Miller et al. | 206/562 |
| 5,520,119 | A | | 5/1996 | Eisenberg | |
| 6,095,058 | A | * | 8/2000 | Earnhart | 108/43 |
| 6,173,656 | B1 | * | 1/2001 | Blanchard | 108/43 |
| 6,349,729 | B1 | * | 2/2002 | Meyer et al. | 108/43 |
| 6,401,927 | B1 | | 6/2002 | Sorensen et al. | |
| 2007/0205640 | A1 | | 9/2007 | Pecorino | |
| 2009/0140023 | A1 | | 6/2009 | Noble | |

* cited by examiner

*Primary Examiner* — Luan K Bui
(74) *Attorney, Agent, or Firm* — Naomi Assia Law Offices c/o Landon IP, Inc

(57) ABSTRACT

A tray is disclosed herein, for supporting food and/or drink upon the lap of a user. The underside of the tray has a bowed stand, which is contoured to fit between the thighs of a seated user. The bowed stand provides optimal support, and is especially advantageous for use in a moving vehicle, to prevent sliding of the tray and spillage.

9 Claims, 11 Drawing Sheets

FOOD TRAY

FIELD OF THE INVENTION

The invention relates to a food tray designed to be placed on the lap of a user.

BACKGROUND OF THE INVENTION

Many types of packaging are known for use with food marketed by fast food-type restaurants. Specialized bags and boxes are known, which fit and surround the containers containing the food served, and which can be used to transport these food containers to a waiting vehicle. For instance, U.S. Pat. No. 4,705,173 to Forbes describes a carryout tray with top, bottom and side walls. Slots are provided for various foods and for a drink. The Forbes patent is expensive to manufacture due to its layered construction, which requires a relatively large amount of material, as can be seen in the unfolded view of FIG. 1.

U.S. Pat. No. 6,401,927 to Sorensen et al. describes a tray for take-out food, having slots for food, drink and condiments, and pop-out legs at its extremities which support the tray when placed on the lap of a user. The Sorensen patent suffers from the disadvantage of having the cup-holder off-set to one side, which makes the tray unwieldy to balance when filled, tending to tip towards the cup-heavy portion. Additionally, the tray will tend to slide when the vehicle moves, as the tray cannot be anchored in place during use.

An attempt to overcome this problem is found in U.S. Pat. No. 5,520,119 to Eisenberg, which describes a lap tray for use in a moving vehicle. The tray has straps which surround a user's legs to anchor the tray. The straps are independent of the seat-belt. Inclusion of straps adds considerably to the cost of manufacture. The strap arrangement would not be suited to young children, who tend to resist being constrained.

Novelty trays include U.S. Patent Publication No. 2009/0140023 to Noble, describing a compartmentalized tray which may be hung from the vehicle window or may be placed on a lap; and U.S. Patent Publication No. 2007/0205640 to Pecorino, which describes a compartmentalized tray to be hung from the seat-back of a chair in front of the user, such as in a stadium.

The need exists for a food tray with a simpler design, which would be economical to manufacture, having a minimal amount of material. The food tray should be properly designed to be balanced when full, and not side-heavy which would be cumbersome. The tray should have an anchoring element such as a stand which prevents tipping or sliding when used in a moving vehicle.

The present invention provides a tray overcoming these disadvantages; the tray is simple to manufacture and thus inexpensive to produce. These and other advantages are described in the detailed description of the invention that follows.

SUMMARY OF THE INVENTION

There is thus provided in the invention, a tray for supporting food and drink, comprising:

a) a planar board including at least one slot for receiving one or more of the following: a drink cup, a food item, a condiment, or combinations thereof;

b) a bowed stand fixed to the underside of the planar board, the bowed stand is contoured to fit between the thighs of a seated user, for support of the tray.

Optionally, the bowed stand is located centrally underneath the planar board.

The tray may be formed of a material selected from: paperboard, corrugated cardboard, a polystyrene foam, plastic, wood and chipboard.

When the tray comprises a slot for receiving a drink cup, optionally the slot is located midway upon the longitudinal axis of the planar board, for maintaining optimal balance of the tray.

In certain embodiments, the bowed stand is two-ply.

Optionally, the bowed stand is fixed with adhesive to the planar board via a flap.

Additionally, the bowed stand may be folded when not in use, to become essentially parallel to the planar board.

In certain embodiments of the tray, a slot is present for receiving condiments. The slot includes a recessed bottom wall, and the slot is tub-shaped for retaining the condiments within.

Moreover, the planar board may have a shape, included in the following group: rectangular, oval, square and circular.

BRIEF DESCRIPTION OF THE DRAWINGS

For a better understanding of the invention, with regard to the embodiments described, reference is made to the accompanying drawings, in which:

FIGS. 6A and 6B are perspective views of the underside of a tray.

FIGS. 7A and 7B are perspective views of the underside of a tray.

FIG. 8A is a frontal view, FIG. 8B is a top view, FIG. 8C illustrates the underside of tray, FIG. 8D is a side view and FIG. 8E is a perspective view.

FIG. 9A is a frontal view, FIG. 9B is a top view, FIG. 9C illustrates the underside of tray, FIG. 9D is a side view and FIG. 9E is a perspective view.

FIG. 10A is a frontal view, FIG. 10B is a top view, FIG. 10C illustrates the underside of the tray, FIG. 10D is a side view, and FIG. 10E is a perspective view.

FIG. 11A is a frontal view, FIG. 11B is a top view, FIG. 11C illustrates the underside of the tray, FIG. 11D is a side view, and FIG. 11E is a perspective view.

DETAILED DESCRIPTION OF THE INVENTION

The invention discloses a tray especially suited for use with food sold in a fast food-type of restaurant. The tray has a bowed stand which may be placed between the thighs of a seated user, to stabilize the tray when used in a moving vehicle. The tray has slots for retaining food(s), a drink cup and condiments. The tray is minimalistic in design and thus inexpensive to manufacture, and may be readily disposed of after use.

Figure 1:
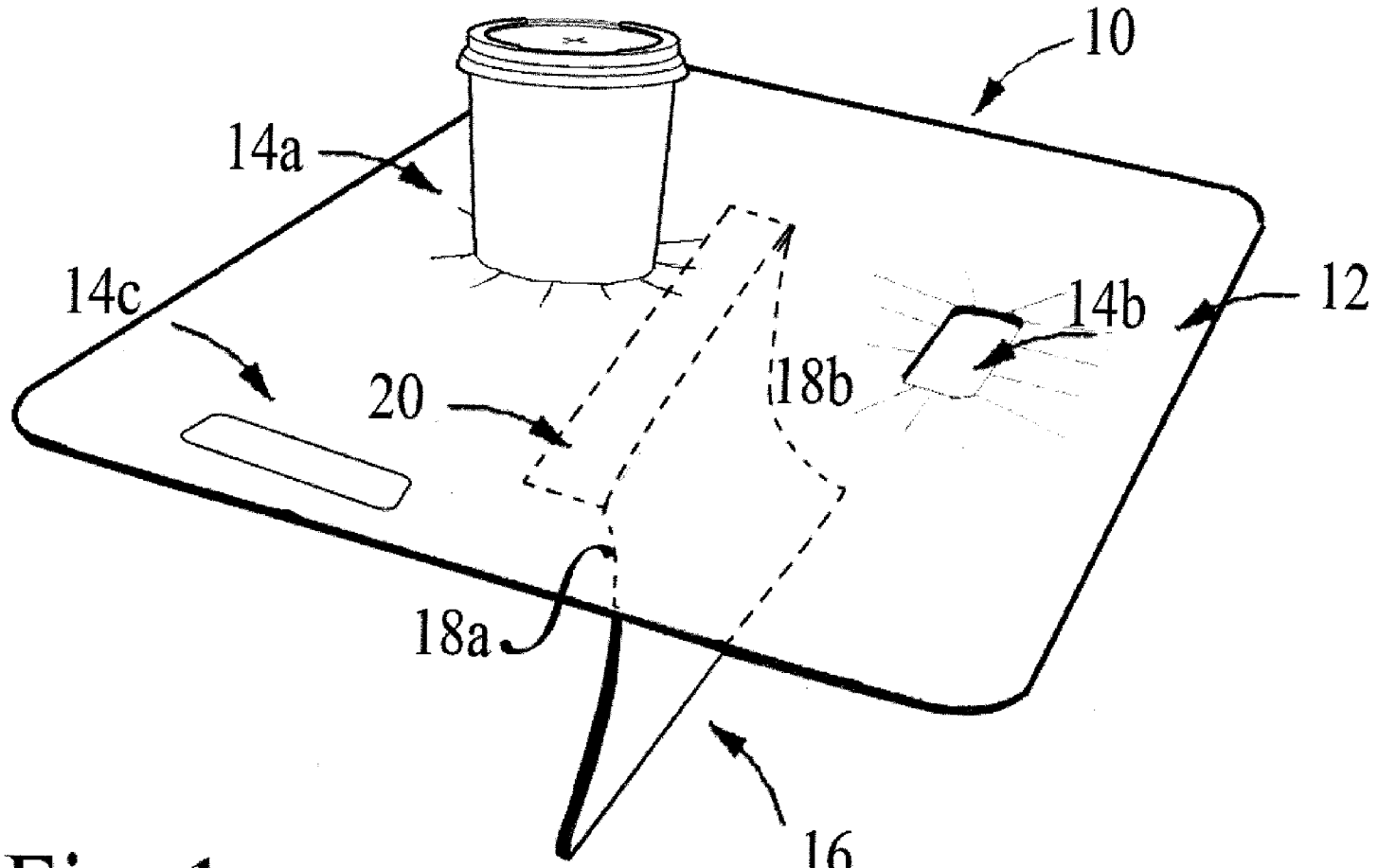
FIG. 1 is a perspective view of the tray of the invention.

Referring now to FIG. 1, the tray 10 is comprised of a planar board 12, which is depicted in FIG. 1 as rectangular. The planar board 12 may have any shape, such as oval, square, circular, etc. Planar board 12 has slot 14*a* for receiving a drink cup, slot 14*b* for receiving food (e.g. a wrapped sandwich or a package of fries), slot 14*c* for receiving condiments (e.g. ketchup, mustard, etc). The planar board 12 is supported by a bowed stand 16, which may be placed between the thighs of a seated user, to stabilize the tray. The bows 18*a*, 18*b* of bowed stand 16 are contoured to fit within the thighs of a seated user, in a comfortable manner. Bowed stand 16 will prevent slippage and movement of the tray 10 when used in a moving vehicle or in any another location. Bowed stand 16 is typically attached to the underside of planar board 12 via flap 20, using any suitable adhesive.

Optionally, staples, hook-and-loop fastening, or other fasteners may be used for this purpose.

When not in use, bowed stand 16 may be folded upwards (described herein below in relation to FIGS. 6-7) to become essentially parallel to planar board 12.

In one presently preferred embodiment, slot 14*a* for receiving a drink cup is located midway upon the longitudinal axis of planar board 12, generally opposite the face of a seated user. This location is advantageous for maintaining optimal balance of the tray 10 when it is carried by a user, as the drink cup is generally the heaviest item included in the meal. In contrast, in many prior art trays the cup holder is offset to one side, resulting in a cumbersome tray which tends to tip when carried.

Slot 14*c* for receiving condiments, may have a recessed bottom wall, such that slot 14*c* is tub-shaped for retaining the condiments within.

Figure 2:
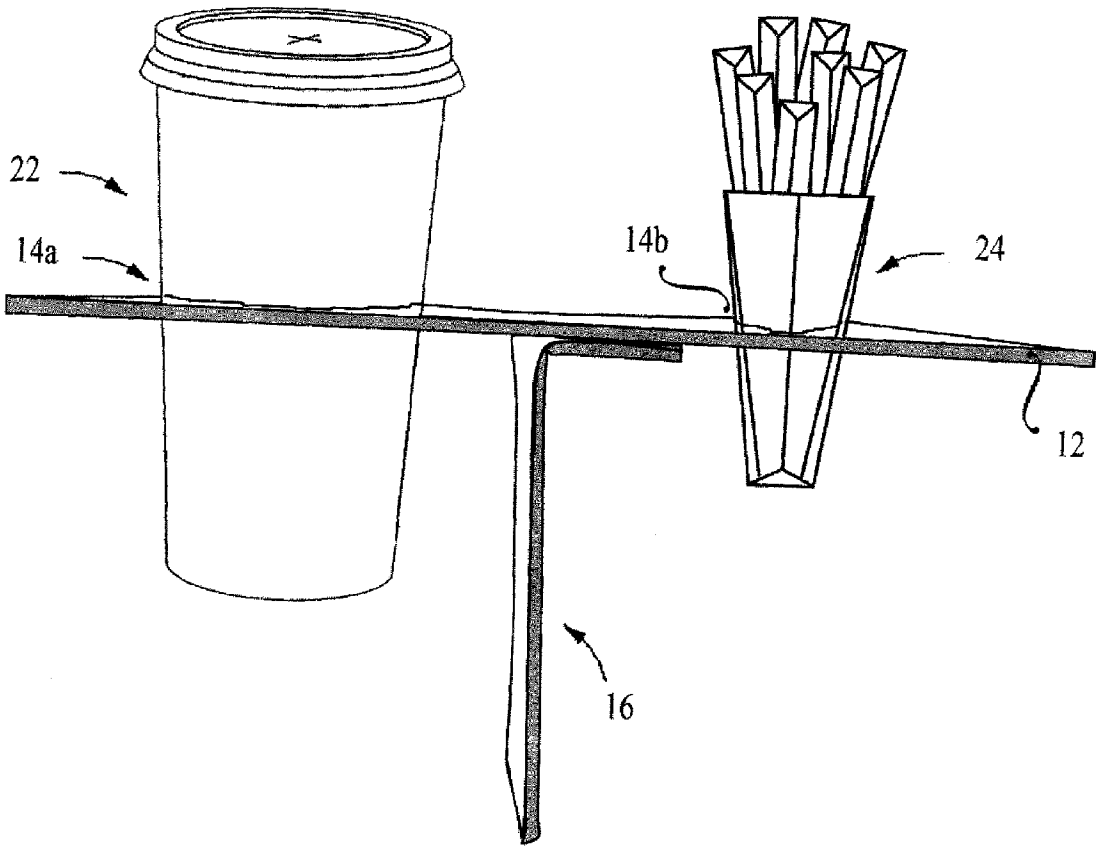
FIG. 2 is a side view of the tray.

Referring to FIG. 2, tray 10 is shown in side view, after drink cup 22 has been placed into slot 14*a*, and fries 24 have been inserted into slot 14*b*. Bowed stand 16 is perpendicular to planar board 12, and is in "ready" state for placement between the thighs of a seated user.

Figure 3:
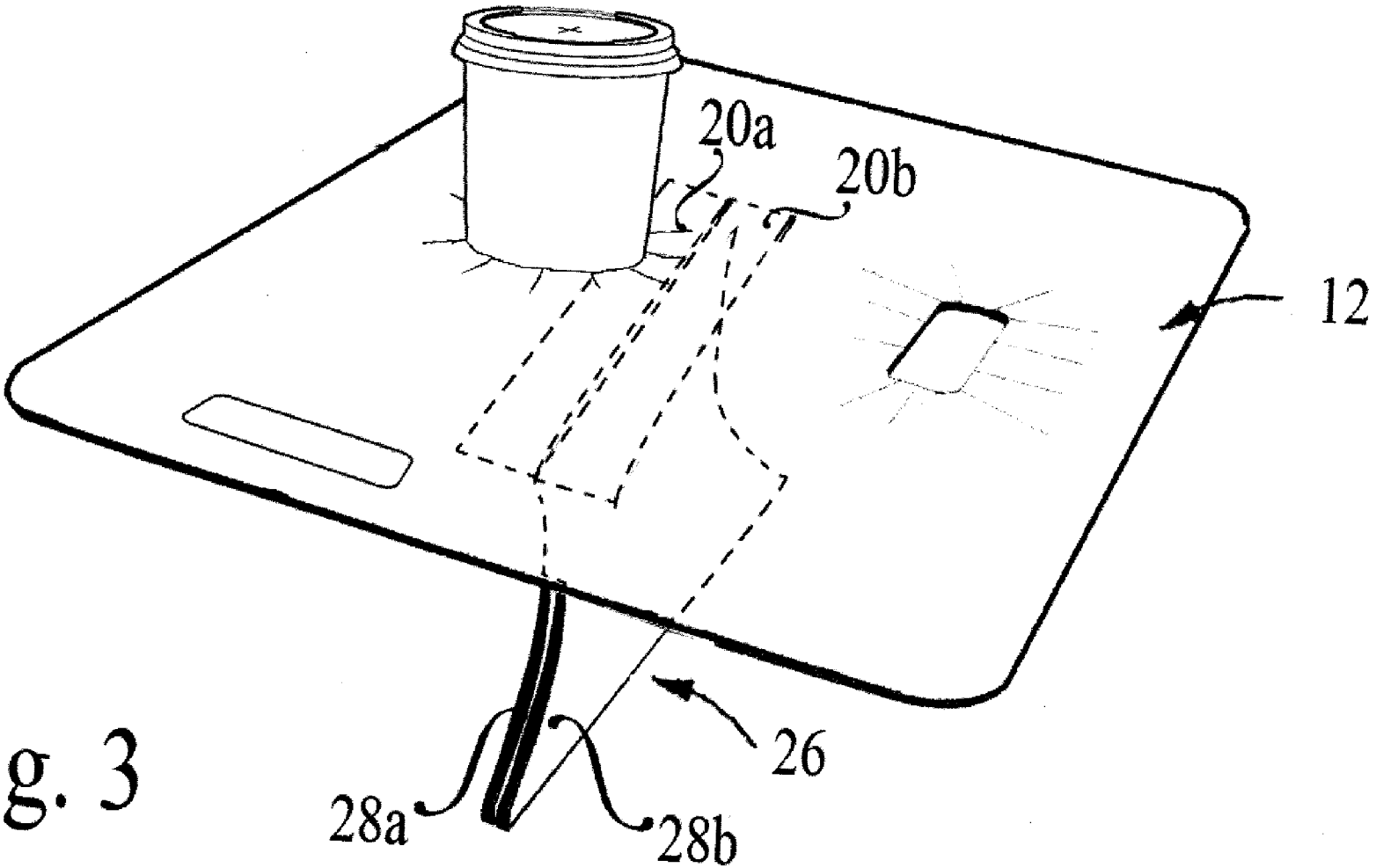
FIG. 3 is a perspective view of another embodiment of the tray, having a two ply stand.

Referring to FIG. 3, a perspective view is shown of another embodiment of the tray 10, having a two ply stand 26. Two ply stand 26 is comprised of corresponding bowed elements 28*a*, 28*b*, each of which includes a respective flap 20*a*, 20*b* which is attached to the underside of planar board 12. Two-ply stand 26 is intended to be placed between the thighs of a seated user similar to the single-ply stand of FIGS. 1,2; however the two-ply stand of FIG. 3 is bulkier for more solidity. Slots 14*a*, 14*b*, 14*c* for receiving drink cup, food and condiments, are shown.

Figure 4:
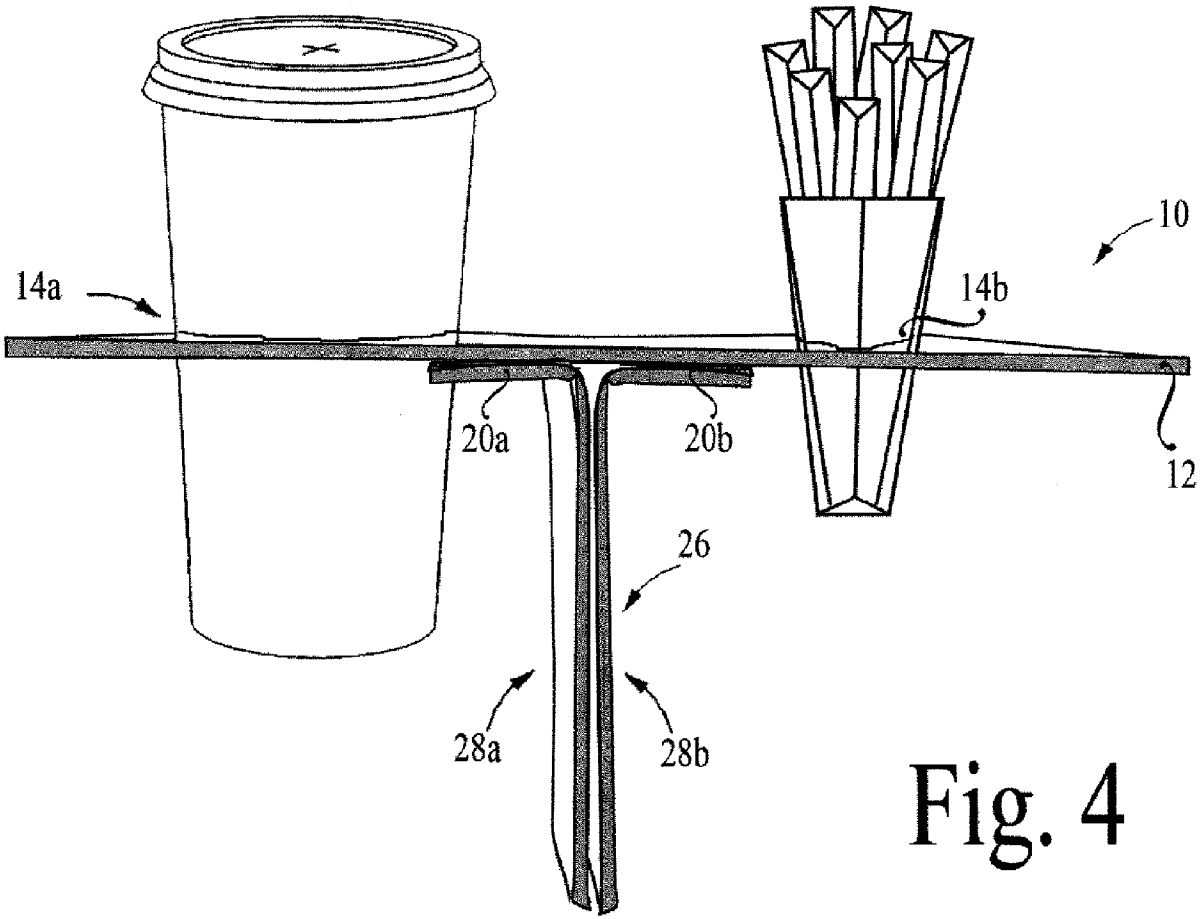
FIG. 4 is a side view of the tray having a two ply stand.

Referring to FIG. 4, tray 10 with two-ply stand 26 is shown in side view. Drink cup 22 has been placed into slot 14*a*, and fries 24 have been inserted into slot 14*b*. Bowed elements 28*a*, 28*b* which comprise two-ply stand 26, are clearly illustrated. Bowed elements 28*a*, 28*b* are attached to underside of planar board via flaps 20*a*, 20*b*.

Figure 5:
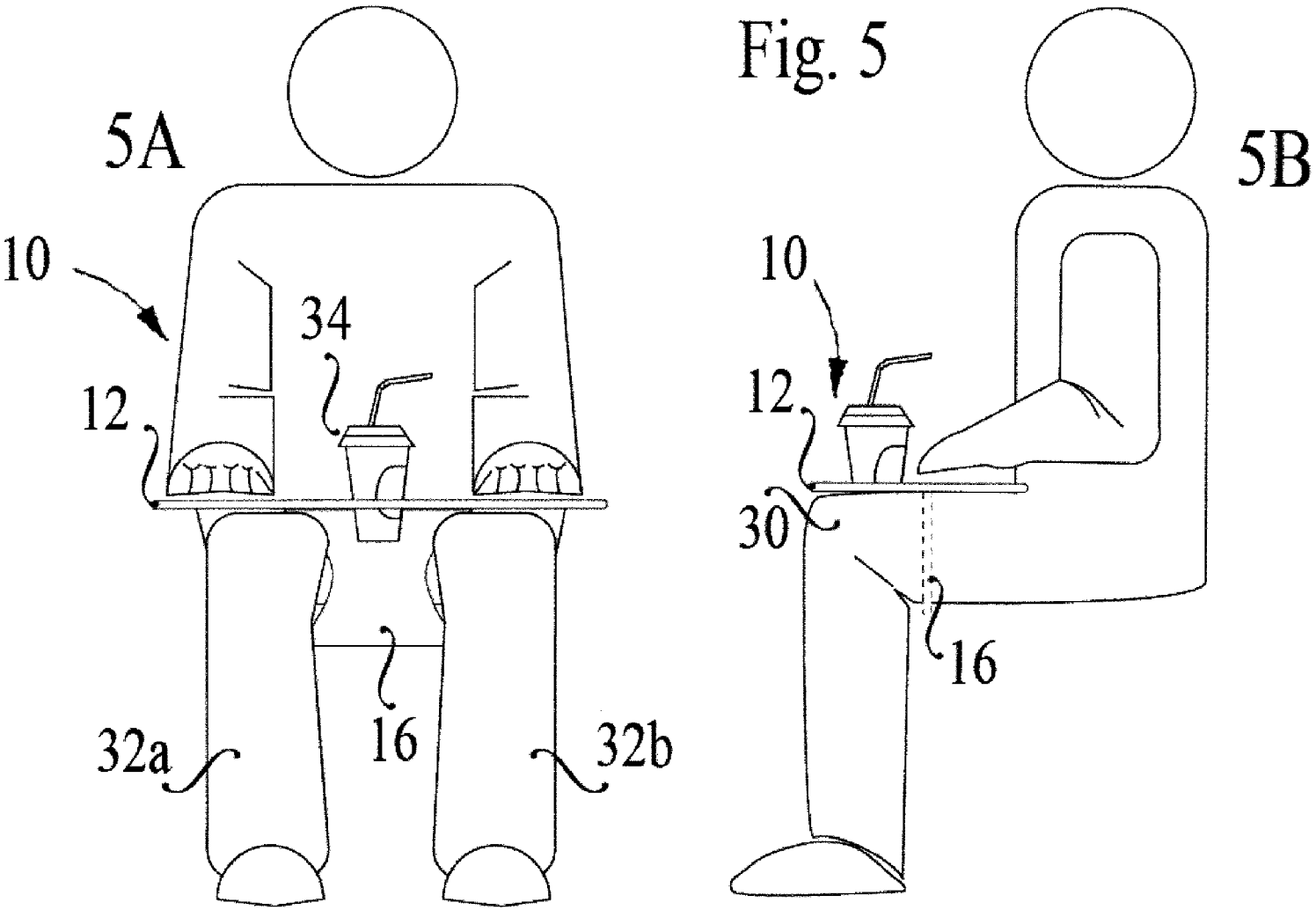
FIG. 5, illustrates tray in use, when placed upon the lap of a seated user, in frontal view (FIG. 5A) and in a side view (FIG. 5B).

Referring to FIG. 5, the tray 10 is shown in use, when placed upon the lap of a seated user, in frontal view (FIG. 5A) and in a side view (FIG. 5B). Planar board 12 rests upon user's lap 30, with bowed stand 16 placed between user's legs 32*a*, 32*b*. Drink cup 34 is seen protruding from drink cup slot (not shown), between user's legs 23*a*, 32*b*. In FIG. 5A, contours of bowed stand 16 are seen to correspond to a user's legs 32*a*, 32*b*, such that bowed stand 16 fits comfortably between the user's legs and stand 16 stabilizes tray 10 and prevents undue movement of tray 10. Slot 14*a* for drink cup is shown to be centered, for optimal balance of tray during use.

Figure 6:
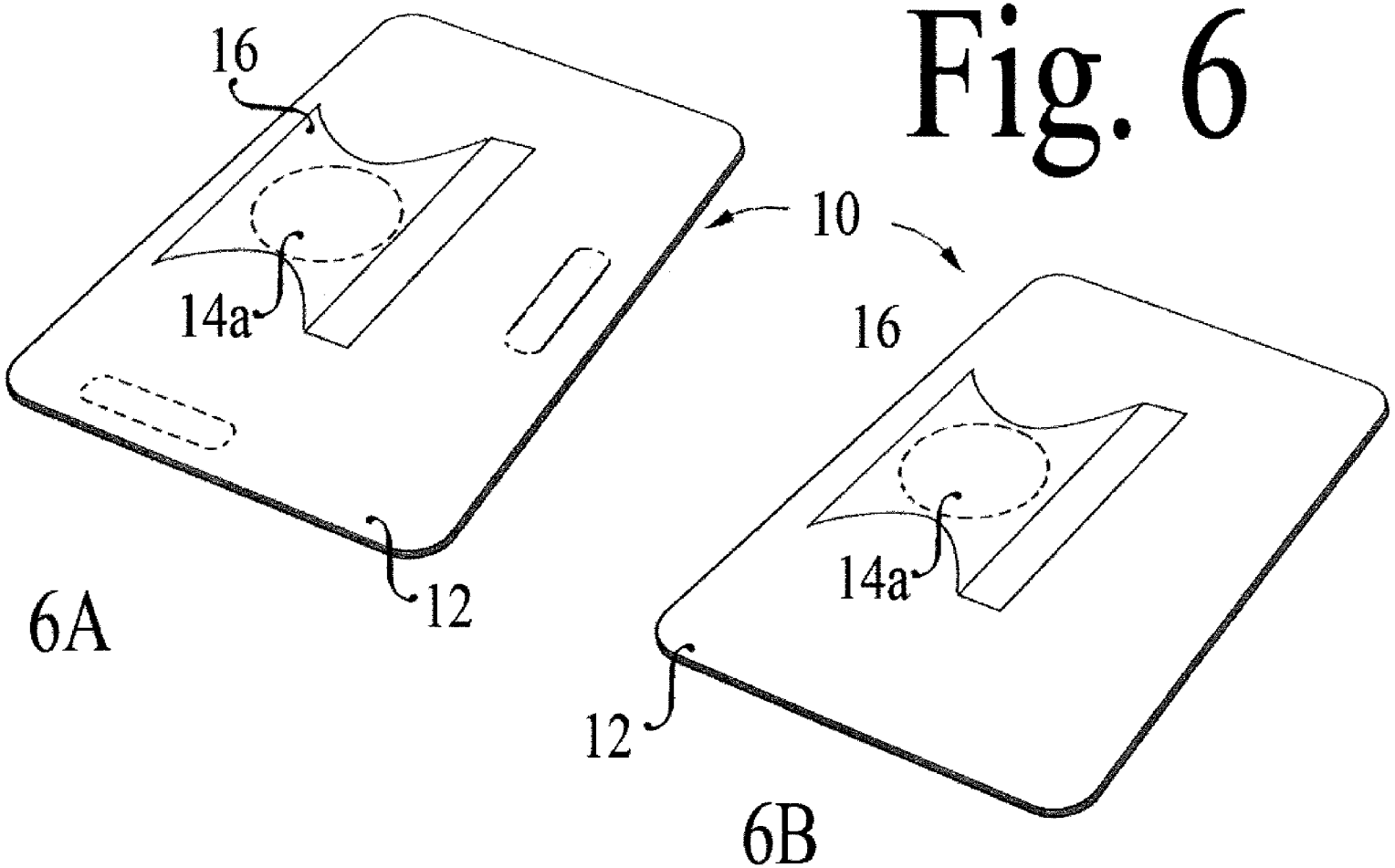
FIG. 6 illustrates tray with bowed stand in folded state. Both

Referring to FIG. 6, tray 10 is shown after bowed stand 16 has been folded to a position essentially parallel to planar board 12, prior to placement upon the user's lap. This folded arrangement allows ease of storage or transport of trays 12. In folded state, bowed stand 16 covers slot 14*a* for receiving a drink cup.

In FIG. 6A, a plurality of slots 14*a*, 14*b*,14*c* are shown, for receiving respectively, a drink cup, food and condiments.

In the embodiment shown in FIG. 6B, tray includes only a single slot 14*a* for receiving only a drink cup.

Figure 7:
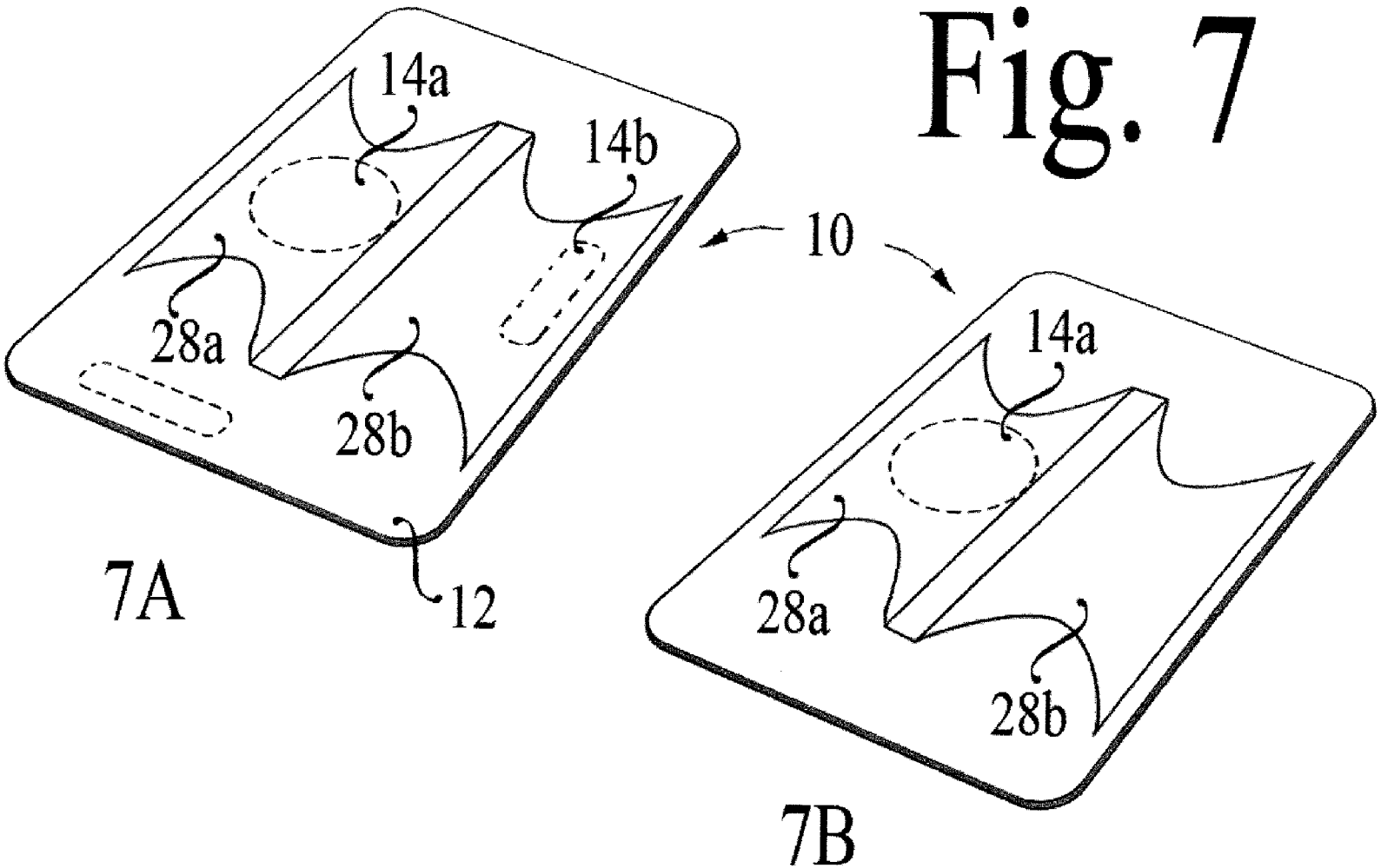
FIG. 7 illustrates tray with two-ply bowed stand in folded state. Both

Referring to FIG. 7, tray 10 with two ply-stand 26 is shown with stand in folded state. Each one of bowed elements 28*a*, 28*b* of two-ply stand 26, has been moved upwards to lie flat against and parallel to planar board 12. In this folded configuration, bowed element 28*a* covers drink slot 14*a*. In FIG. 7A, bowed element 28*b* covers food slot 14*b*, which is not present in FIG. 7B.

Figure 8:
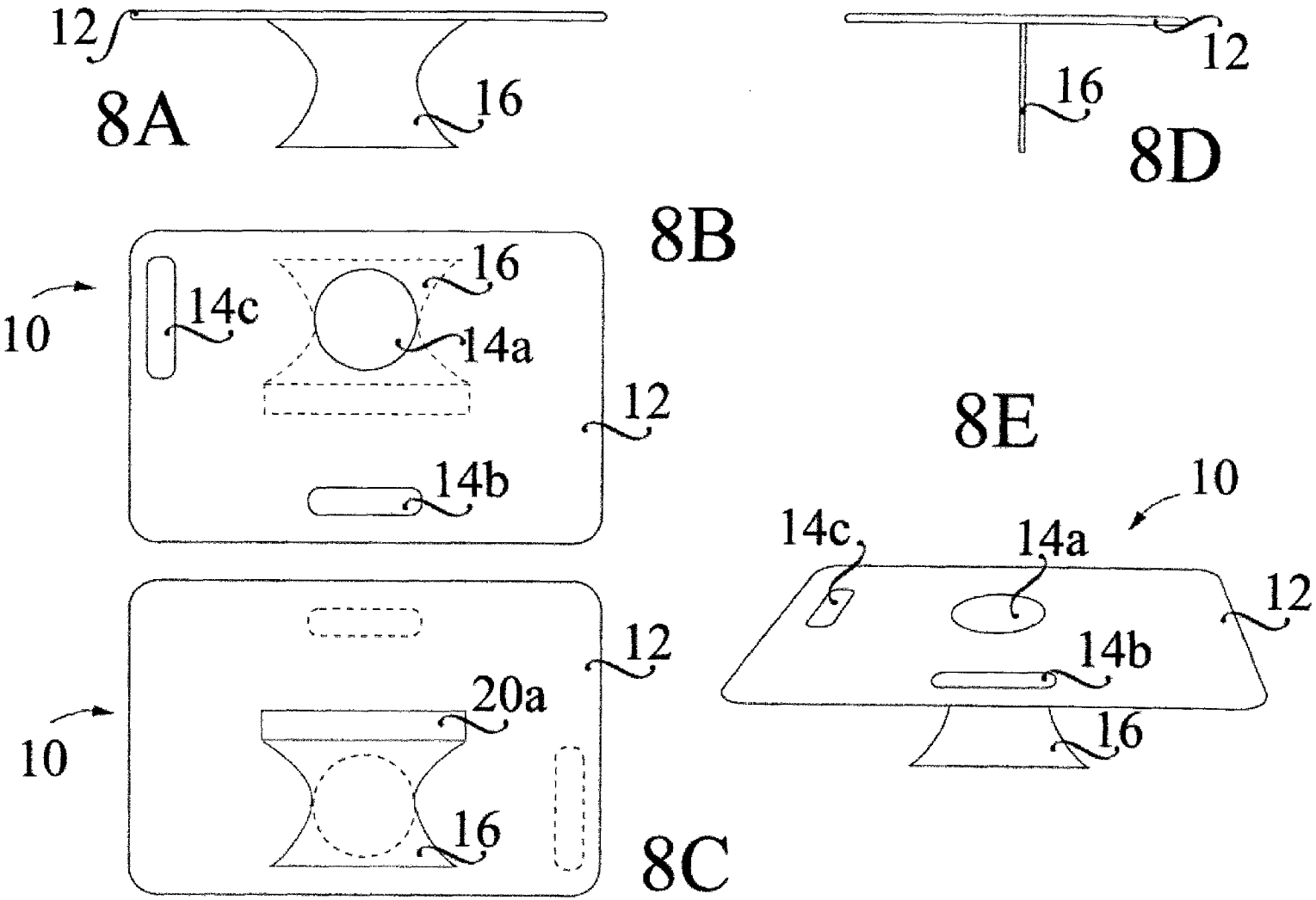
FIG. 8 illustrates tray with a single ply bowed stand in several additional views.

Referring to FIG. 8, tray of the invention, with single ply bowed stand, is shown in several additional views.

Referring to FIG. 8A, tray 10 is shown in side view, with bowed stand 16 present in "ready" state, for placement between a user's thighs. Tray is viewed as it would appear from headlong opposite a seated user.

FIG. 8B illustrates a top view of tray 10. Slots 14*a*, 14*b*, 14*c* for receiving drink cup, food and condiments, respectively, are shown.

FIG. 8C illustrates a view of the underside of the tray 10. Bowed stand 16 is visible, and is attached to tray 10 via flap 20*a*.

FIG. 8D is a side view of tray 10, showing bowed stand 16 in side view.

FIG. 8E is a perspective view of tray 10.

Figure 9:
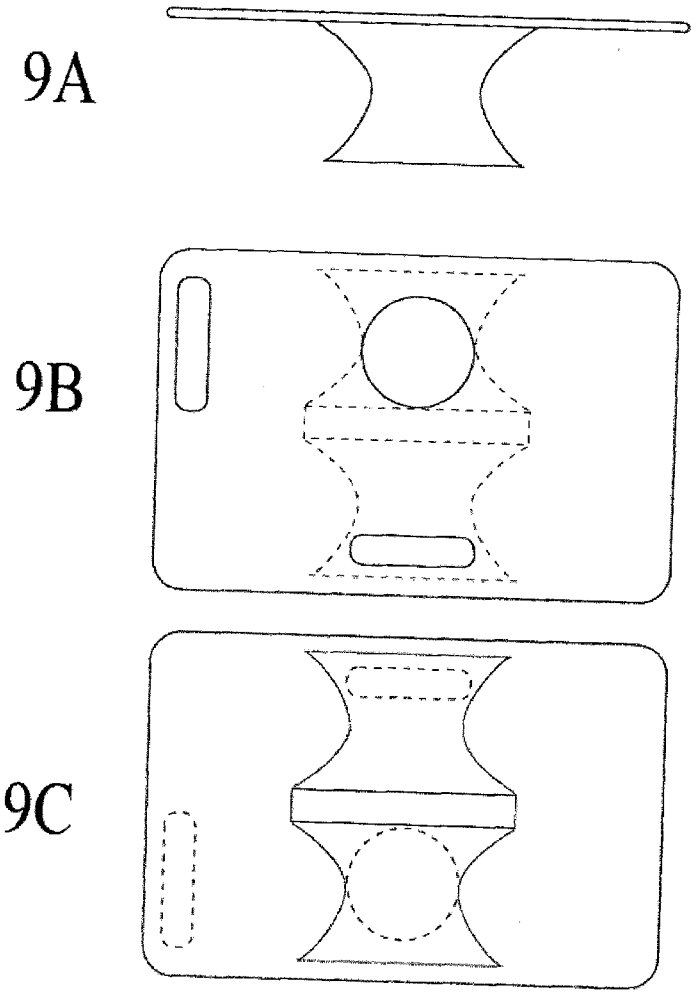
FIG. 9 illustrates tray having a double-ply stand in several views.

Referring to FIG. 9, tray 10 having a double-ply stand 26 is shown in several views. The perspectives are similar to the views illustrated in FIG. 8.

Figure 10:
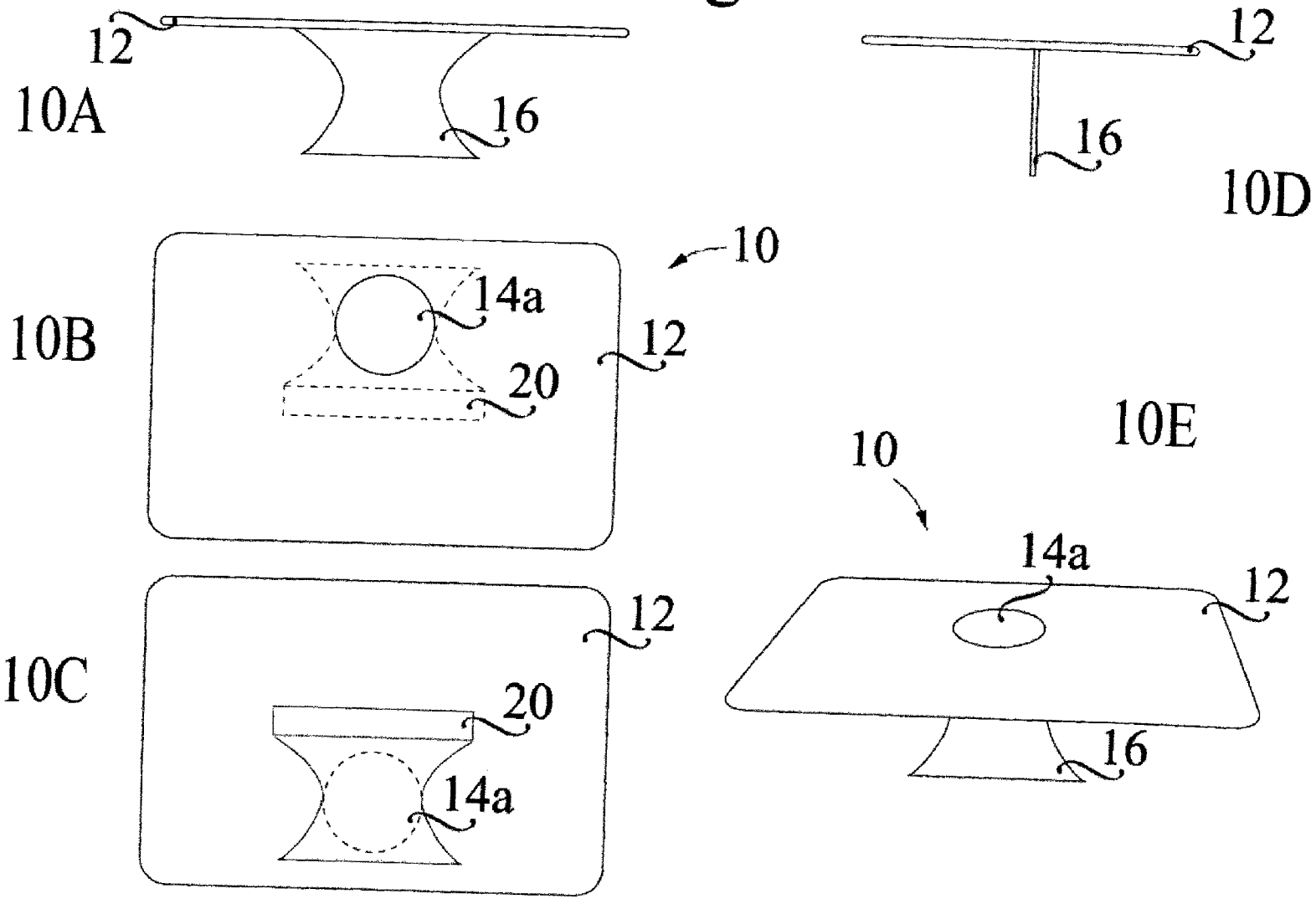
FIG. 10 illustrates several views of another embodiment, in which a single slot for receiving a drink cup, is present.

Referring to FIG. 10, tray 10 of the invention is shown in several views of another embodiment, in which a single slot 14*a* for receiving a drink cup, is present.

Figure 11:
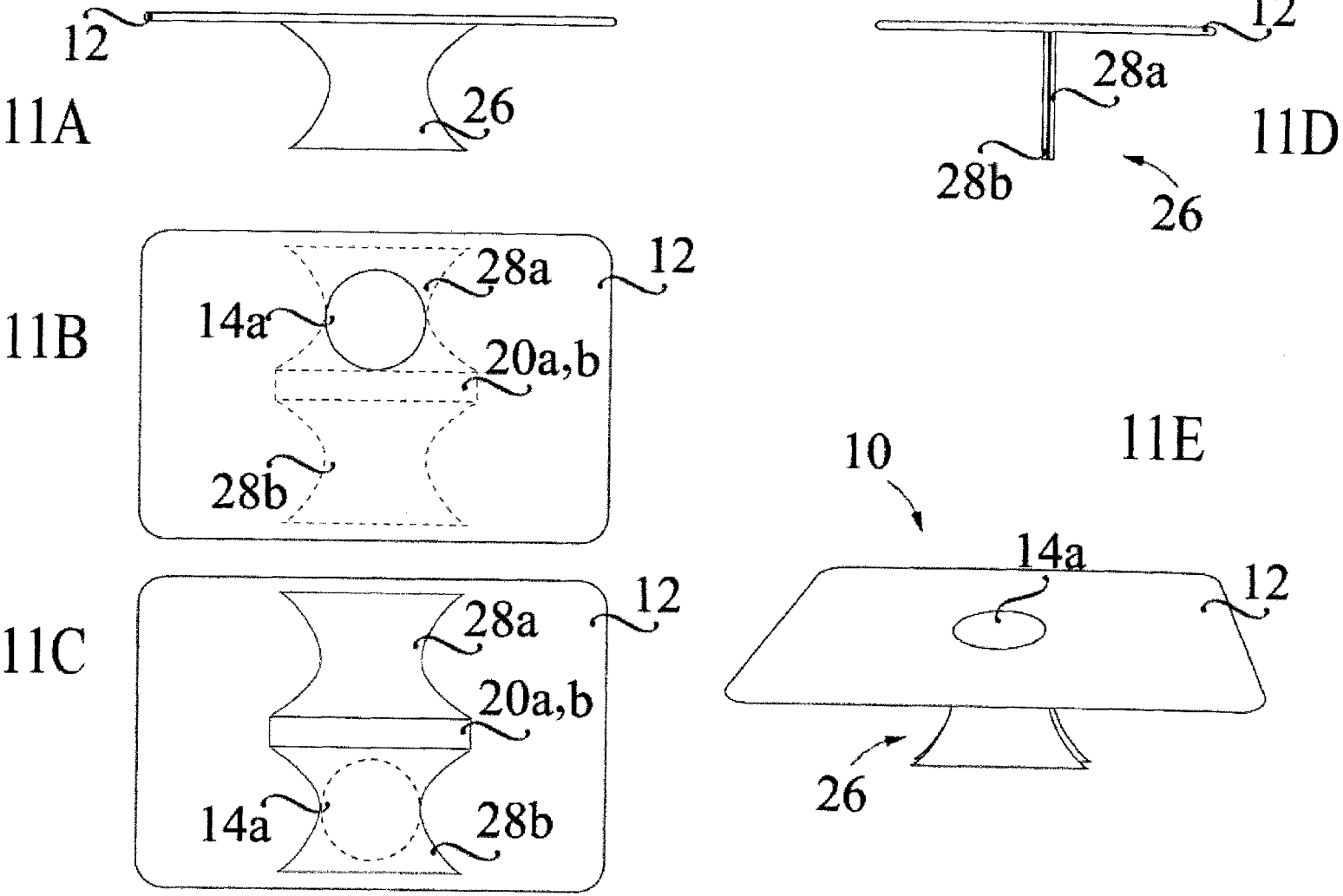
FIG. 11 illustrates several views of an embodiment of the tray, in which a single slot for a drink cup is present, and tray has a double-ply stand.

Referring to FIG. 11, another embodiment of tray 10 is shown in several views, in which a single slot 14*a* for drink cup is present, and tray 10 has a double-ply stand 26. Stand 26 is formed of two bowed elements 28*a*, 28*b*, which are attached to planar board 12 via their respective flaps 20*a*, 20*b*.

Planar board 12 may be formed of any material. Materials best suited for single use include paperboard of any ply, corrugated cardboard, foam (XPS foam or other polystyrene foams). Manufacture of slots for receiving food, drink and condiments, is dependent upon the material used, and may include die-cutting, molding, scoring, etc. Materials suited for reusable trays, include plastic polymers, wood, chipboard and others.

When the tray is formed of corrugated cardboard, bowed stand will withstand a relatively large degree of pressure placed upon the stand by the thighs of a seated. This, since the wavy corrugation folds are directed against the direction where pressure is exerted by the thighs.

The tray may be recycled or discarded after a single use, or may be reused any number of times.

The tray may be used in sports arenas, convenience stores and supermarkets. The upper side of the tray may optionally be embossed with any company logo or design, and may be sold or distributed as a marketing tool or gimmick. The upper side of the tray may have a picture which a child may color in after the food is consumed.

In summary, the tray of the invention is inexpensive to manufacture, having minimal components and a minimal amount of material. Included in its uses, is use with fast-food takeout. The bowed stand, when placed between a seated user's thighs, grants stability and prevents slippage, such as tends to occur in a moving vehicle. The preferred placement of the drink cup slot offers optimal balance of the tray.

The tray and its bowed stand, overcome disadvantages of prior art trays, which tend to be expensive to manufacture due to their complex design, and do not prevent slippage or sufficient stability during eating.

Having described the invention with regard to certain specific embodiments thereof, it is to be understood that the description is not meant as a limitation, as further modifications will now become apparent to those skilled in the art, and it is intended to cover such modifications as are within the scope of the appended claims.

The invention claimed is:

1. A tray for supporting food and drink, comprising:

a) a planar board including at least one slot for receiving one or more of the following: a drink cup, a food item, a condiment, or combinations thereof;

b) a bowed stand fixed to the underside of said planar board, wherein said bowed stand has two contoured edges to fit between the thighs of a seated user when in use, one edge contacting one of the user's thighs and the other edge contacting the other of the user's thighs, for support of said tray;

wherein said bowed stand is foldable at a fold when not in use to become essentially parallel to said planar board, the fold being located along the underside of the planar board and extending in the direction from one of the user's thighs to the other of the user's thighs when in use by the seated user.

2. The tray of claim 1, wherein said bowed stand is located centrally underneath said planar board.

3. The tray of claim 1, wherein said tray is formed of a material selected from: paperboard, corrugated cardboard, a polystyrene foam, plastic, wood and chipboard.

4. The tray of claim 1, wherein said at least one slot includes a slot for receiving a drink cup, said slot for receiving a drink cup being located midway upon the longitudinal axis of said planar board, for maintaining optimal balance of said tray.

5. The tray of claim 1, wherein said bowed stand is two-ply.

6. The tray of claim 1, wherein said bowed stand is fixed with adhesive to said planar board via a flap.

7. The tray of claim 1, wherein said at least one slot includes a slot for receiving condiments, said slot for receiving condiments including a recessed bottom wall, and said slot for receiving condiments being tub-shaped for retaining the condiments within.

8. The tray of claim 1, wherein said planar board has a shape, included in the following group: rectangular, oval, square and circular.

9. The tray of claim 1, wherein said tray is disposable.

* * * * *